US008061291B2

(12) United States Patent
Seim et al.

(10) Patent No.: US 8,061,291 B2
(45) Date of Patent: Nov. 22, 2011

(54) GEOSTATIONARY ANCHORING AND RISER ARRANGEMENT ON A SHIP

(75) Inventors: Lars Seim, Espeland (NO); Jostein Erstad, Ask (NO); Atle Ingebrigtsen, Paradis (NO)

(73) Assignee: Framo Engineering AS, Bergen (NO)

( * ) Notice: Subject to any disclaimer, the term of this patent is extended or adjusted under 35 U.S.C. 154(b) by 99 days.

(21) Appl. No.: 12/162,882

(22) PCT Filed: Feb. 1, 2007

(86) PCT No.: PCT/NO2007/000033

§ 371 (c)(1),
(2), (4) Date: Feb. 5, 2009

(87) PCT Pub. No.: WO2007/089157

PCT Pub. Date: Aug. 9, 2007

(65) Prior Publication Data

US 2009/0217858 A1 Sep. 3, 2009

(30) Foreign Application Priority Data

Feb. 2, 2006 (NO) ..... 20060547

(51) Int. Cl.
*B63B 21/24* (2006.01)
*B63B 21/50* (2006.01)

(52) U.S. Cl. ..... 114/293

(58) Field of Classification Search ..... 114/293, 114/230.1, 230.12, 230.13, 230.14, 230.19, 114/230.2; 441/3–5
See application file for complete search history.

(56) References Cited

U.S. PATENT DOCUMENTS

| | | | | |
|---|---|---|---|---|
| 4,892,495 | A * | 1/1990 | Svensen | 441/5 |
| 5,316,509 | A * | 5/1994 | Boatman et al. | 441/3 |
| 5,346,314 | A | 9/1994 | Perratone et al. | |
| 6,502,524 | B1 | 1/2003 | Hooper | |

FOREIGN PATENT DOCUMENTS

| | | |
|---|---|---|
| WO | WO 85/03048 | 7/1985 |
| WO | WO 00/40458 | 7/2000 |
| WO | WO 03/037703 A1 | 5/2003 |

* cited by examiner

*Primary Examiner* — Daniel Venne
(74) *Attorney, Agent, or Firm* — Merchant & Gould P.C.

(57) ABSTRACT

A geostationary anchoring and riser arrangement in a vessel comprises a rotating body (11), which is mounted in a vertical shaft (6) in the vessel (1) by axial and radial annular bearings (31, 32). Above the upper axial and radial bearing (31, 32) is mounted a dynamic primary seal (35), thereby establishing a dry space above the bearings, in the shaft (6). Under the bearing is mounted a secondary seal (41). A fluid manifold (28) is placed in the dry shaft space.

11 Claims, 9 Drawing Sheets

GEOSTATIONARY ANCHORING AND RISER ARRANGEMENT ON A SHIP

Figure 1:
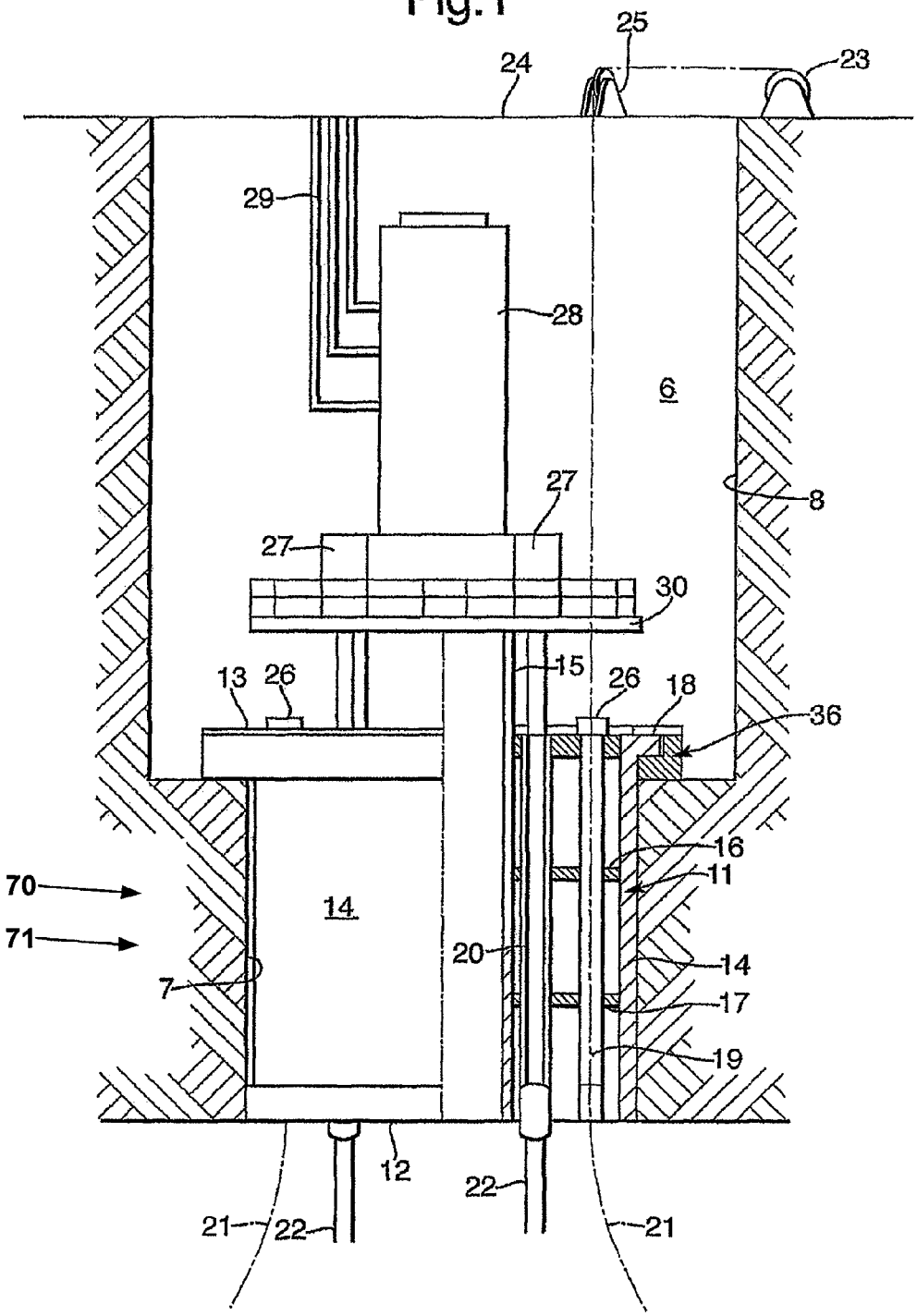

This application is a National Stage Application of PCT/NO2007/000033, filed Feb. 1, 2007, which claims benefit of Serial No. 20060547, filed Feb. 2, 2006 in Norway and which application(s) are incorporated herein by reference. A claim of priority to all, to the extent appropriate is made.

The present invention relates to offshore production of hydrocarbons with the use of a geostationarily anchored vessel. Such a vessel is anchored to the seabed via a body rotatably mounted in the vessel, a so-called turret, from which mooring cables extend to the seabed. From below the vessel risers also ascend through the rotatable body. These risers are connected to a fluid manifold mounted above the rotatable body, from which lines extend for transferring fluid to tanks on board the vessel.

An object of the invention is to provide an improved geostationary anchoring and riser arrangement on a ship, particularly a converted tanker.

The invention is specially developed in connection with a conversion of a tanker as specified in the parallel patent application from the same applicant: "Method for conversion of a tanker", but is not limited to use in connection therewith. The use of the solution according to the invention may well be envisaged in new systems or as a replacement for existing bearing systems. According to the aforementioned parallel application a tanker is provided with a hull containing tanks. In the hull, in one or more tanks, a vertical opening is made, structural elements in the hull, such as frames and stiffeners, being cut and parts of the projected opening removed. A cassette-like structure (cassette) with plate elements is provided designed to fit and connect with the said cut structural elements in the vertical opening, which cassette has a vertical, through-going shaft. The cassette is inserted in the cut-out vertical opening in the hull and connected via the plate elements with the cut structural elements, thereby forming a structure which is incorporated in the hull and forms part of the strength of the surrounding hull. A body is rotatably mounted about a vertical axis in the vertical shaft. The cassette is incorporated in the existing hull in such a manner that the hull's strength is not impaired.

The vertical shaft may advantageously be provided with a lower cylindrical section and an upper cylindrical section extended relative to the lower section, which lower cylindrical section in the cassette's incorporated state will be located near or in the hull's bottom area, the body being rotatably mounted in the transition between the two sections.

By mounting the said body in the transition between the two sections, far down in the hull, preferably near the hull's bottom area, the hull strength that exists in the hull's bottom area is exploited in an advantageous manner.

At the top of the said body a fluid manifold may advantageously be located in the shaft.

This offers the possibility of mounting the fluid manifold in a protected position under the vessel's main deck, in a dry working space in the upper part of the shaft.

The geostationary anchoring and riser arrangement in a vessel according to the invention comprises a body mounted in a vertical shaft in the vessel, which body is rotatably mounted in a wet vessel area about a vertical axis by means of axial and radial, segmented annular bearings, which body has a top side and a bottom side, vertical guides for risers, between top and bottom side, and is provided with an overlying fluid manifold connected to the risers, the arrangement being characterised in that above the said axial/radial bearing there is mounted a dynamic primary seal between the body and the shaft, and that under the said axial/radial bearing there is mounted a secondary seal between the body and the shaft.

The dynamic primary seal permits the space in the shaft above the rotatably mounted body (turret) to be maintained as a dry space, where the fluid manifold can be mounted and to which personnel can have access. The secondary seal is preferably a static seal which only comes into effect when the dynamic primary seal is neutralised in order to provide access to the axial/radial bearing for maintenance and other work.

The mooring cables may be connected to the rotatably mounted body via a structure (anchoring table), thereby obtaining a larger respective lever arm for the mooring cables relative to the body.

A fluid manifold column may particularly advantageously be supported in the shaft by a central stem projecting from the body's top side. This central stem is advantageously provided with an encircling operating deck above the body's top side, and the individual riser is advantageously connected to a suitable block with an ESD (emergency shut-down) valve on a level with the operating deck.

In an advantageous embodiment the body rotatably mounted about a vertical axis is characterised in that it is constructed as a cylindrical plate structure with a top side and a bottom side, with a central stem projecting from the bottom side up through the top side and round the stem, between the bottom side and the top side, distributed casings for risers, which stem is designed to support the fluid manifold.

The support for a body in a vertical shaft in a vessel comprises a segmented annular bearing with adjustable bearing segments, characterised in that the individual bearing segment contains a wearing part against the body, which wearing part may be pressure-lubricated, an intermediate part with a degree of resilience, and a mechanical height-adjustable bottom part against the shaft/the vessel.

Such a design of the individual bearing segment permits it to be adapted to uneven patches in the hull as well as to the hull movements that occur at sea. The mechanically height-adjustable bottom part in the bearing segment permits adjustments to be made during both mounting and dismantling of the bearing segment. Thus by shifting a bearing segment the bottom part can be adjusted so that the load on the bearing segment is relieved relative to the body, thereby permitting it to be easily removed and reinserted or replaced with a new one.

A specially preferred mechanically height-adjustable embodiment of the bottom part is one where the bottom part contains interacting wedges movable relative to each other for the said height adjustment. By moving the wedges relative to each other, the desired adjustment of the bearing segment's height can be achieved. Devices other than a wedge solution may be envisaged for adjusting the bearing segments' height.

In a specially advantageous embodiment the bearing may be disposed in a system for pressure feed of a medium suitable for lubrication of the bearing's bearing segments.

The lubricating medium may, for example, be known per se lubricants, but may also advantageously be pressurised water, particularly when a certain "lift" of the body relative to the annular bearing is required, a film being formed between the body and the bearing segments. The pressure lubrication is important for preventing too much "drag" of the rotatable body when the vessel rotates under the influence of wind and weather. For water lubrication in particular it is an advantage that it is performed in a wet area, basically open to the sea.

Figure 2:
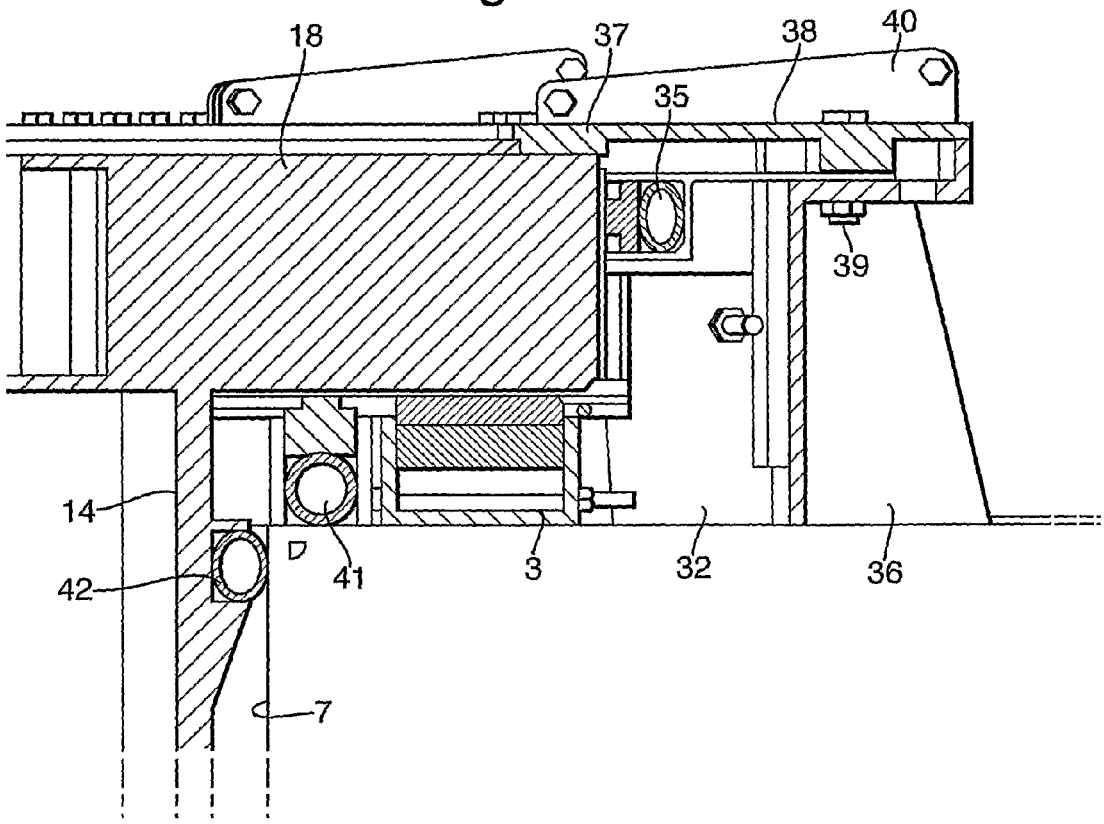
Figure 3:
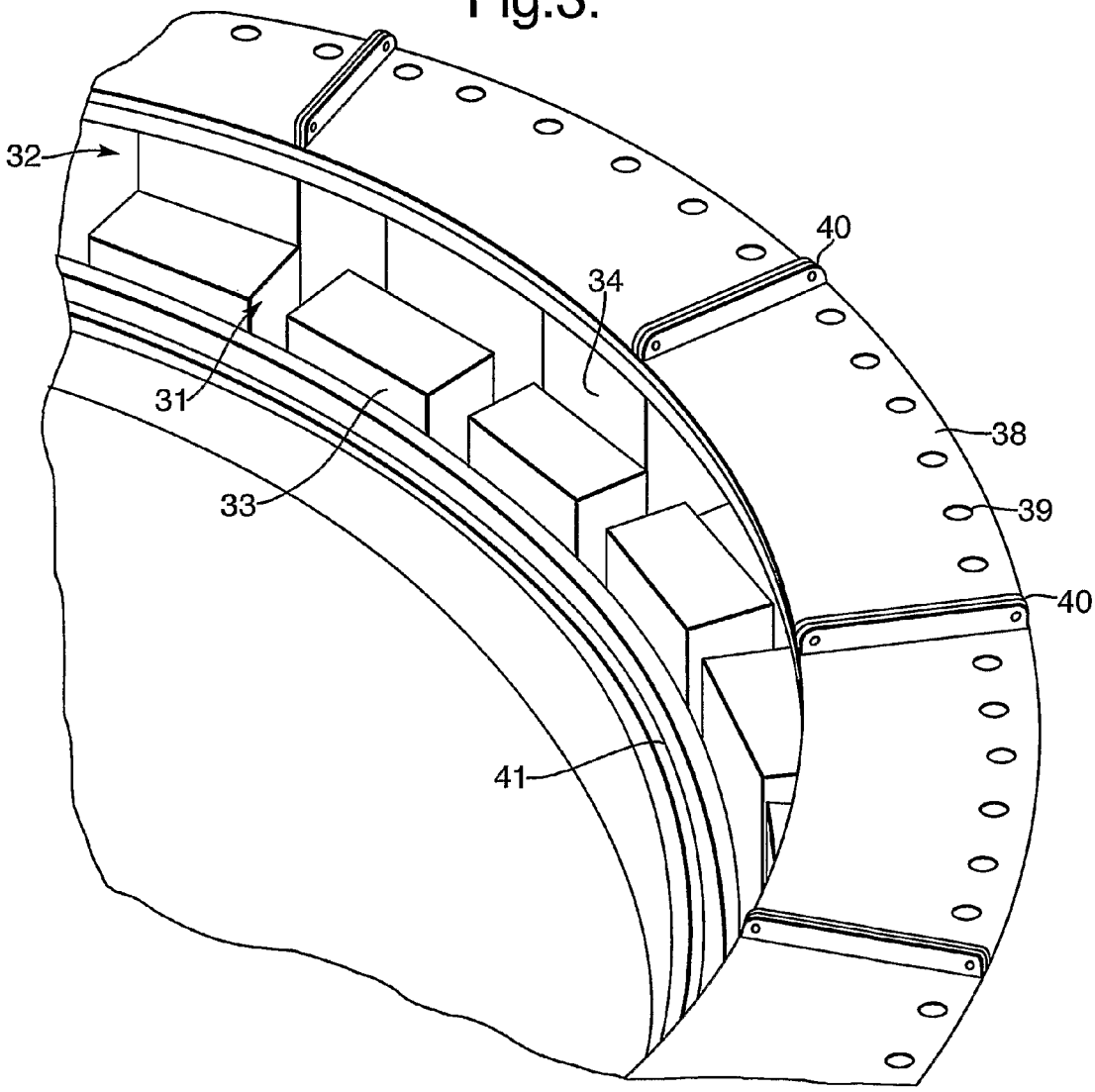
Figure 4:
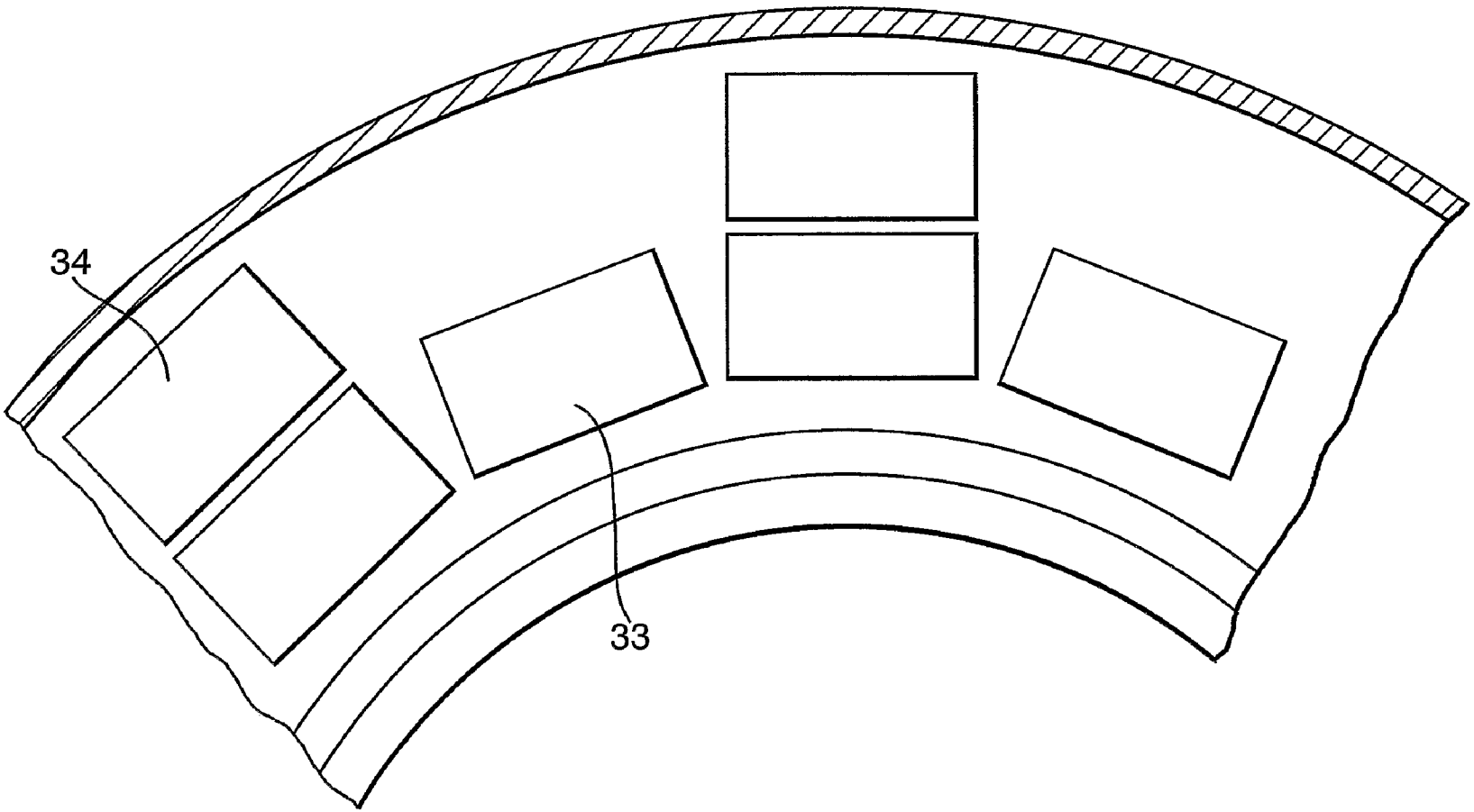
Figure 5:
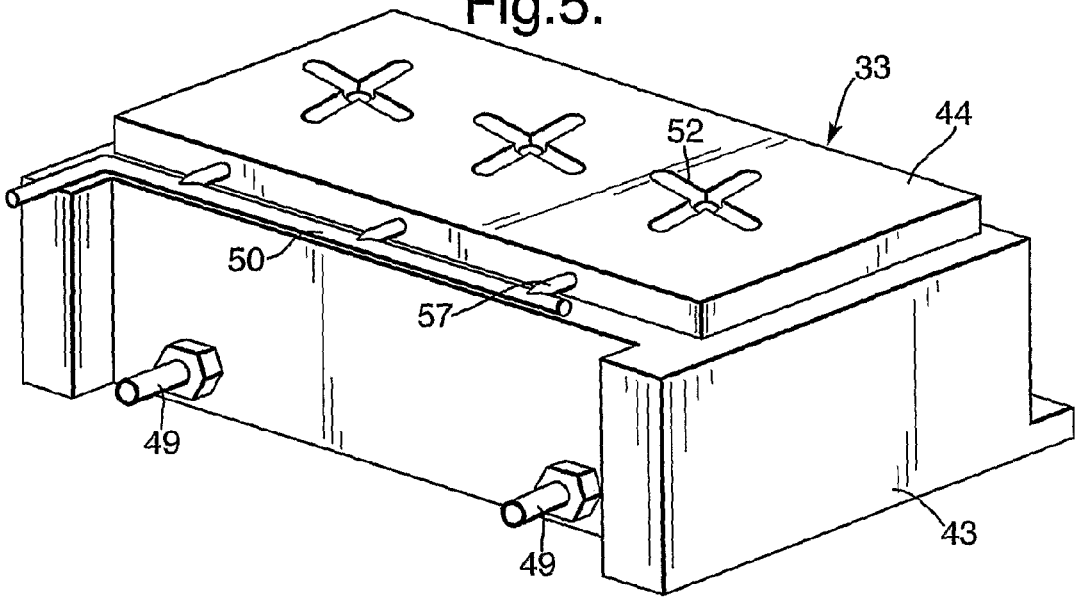
Figure 6:
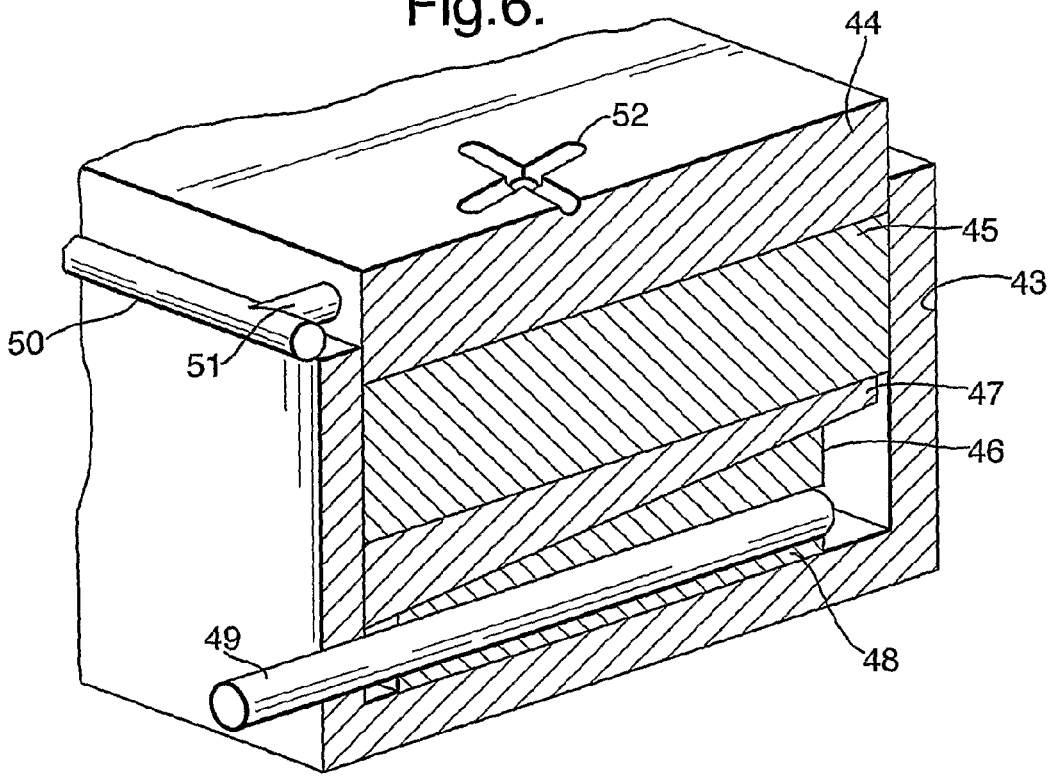
Figure 7:
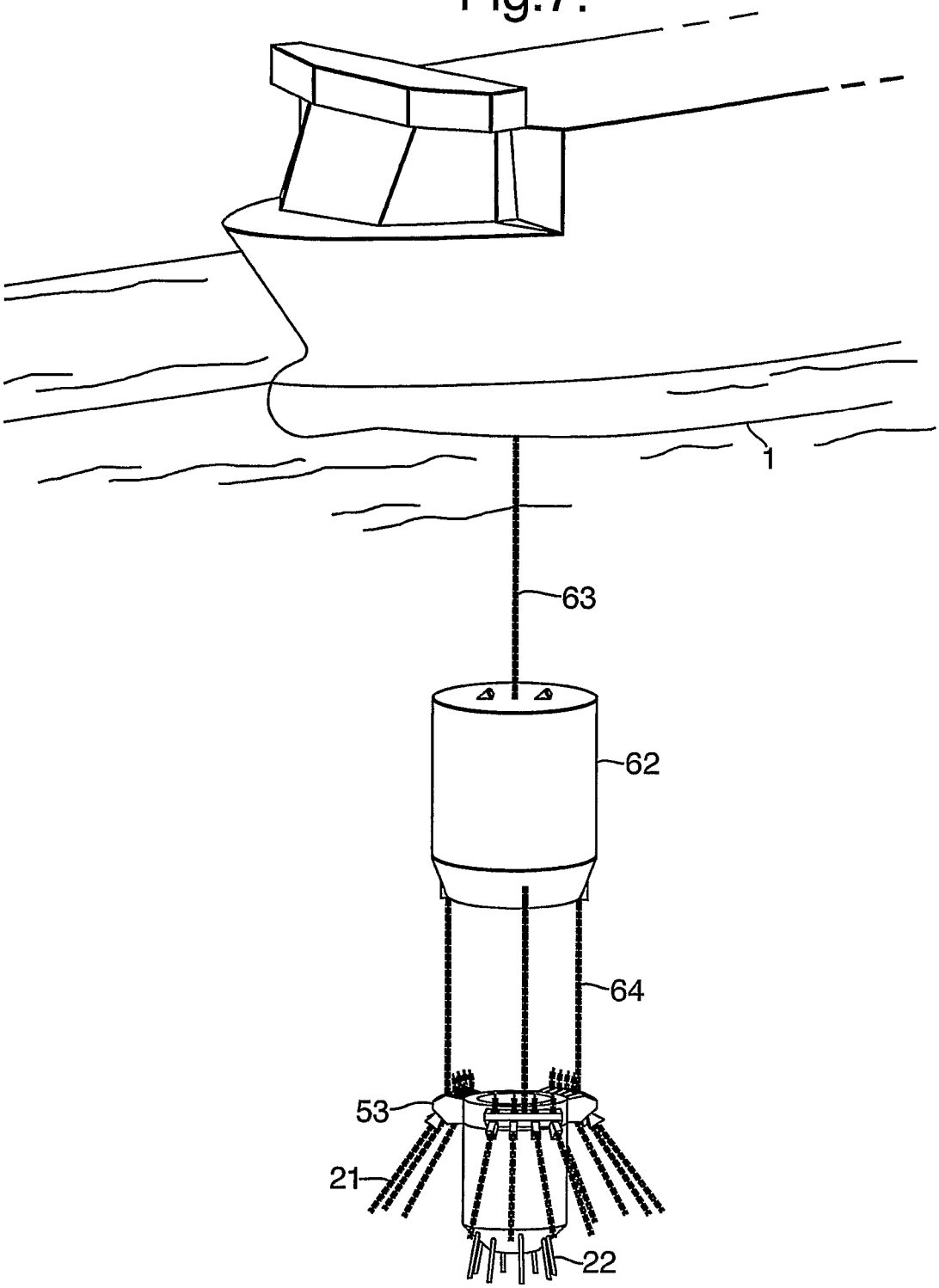
Figure 8:
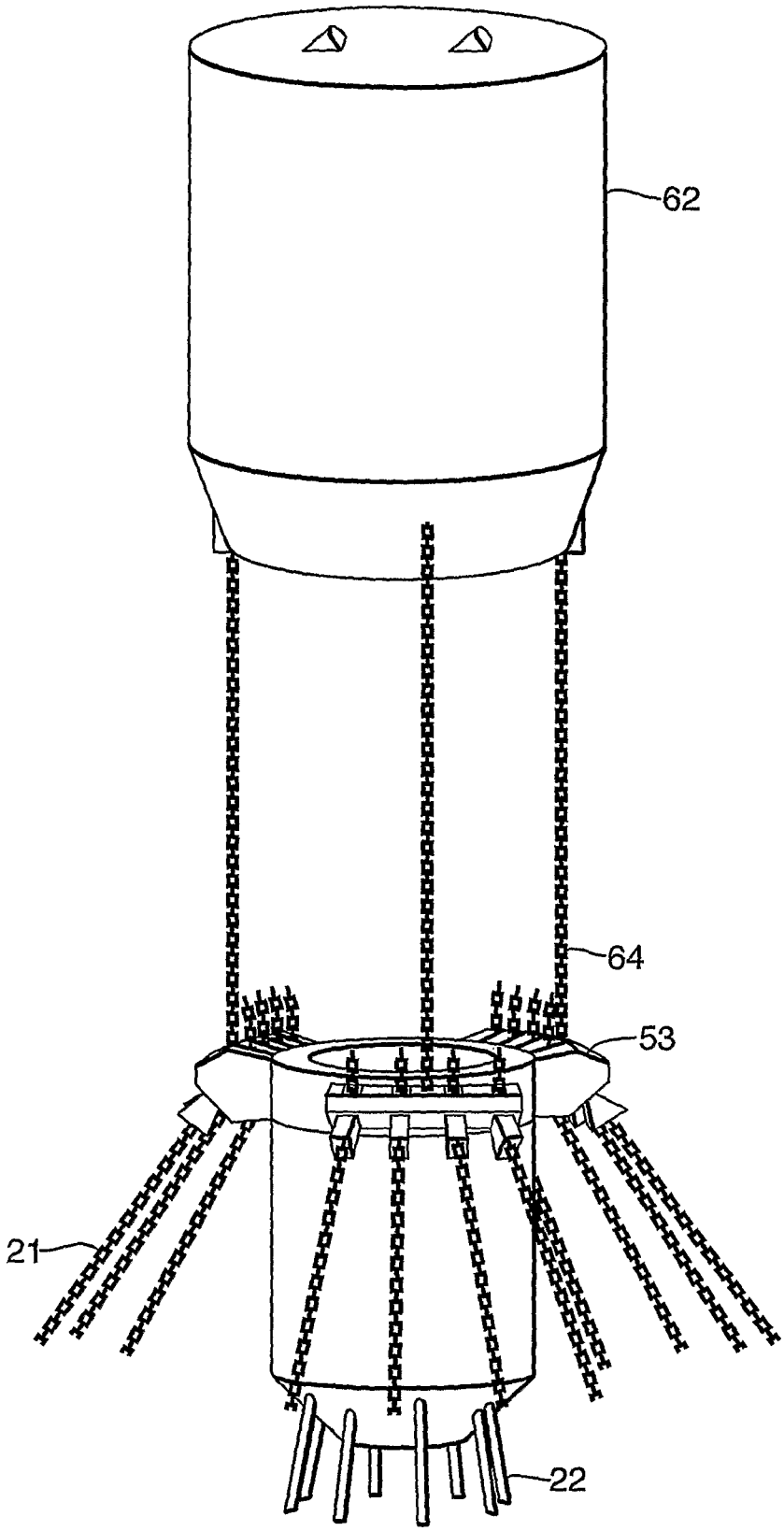
Figure 9:
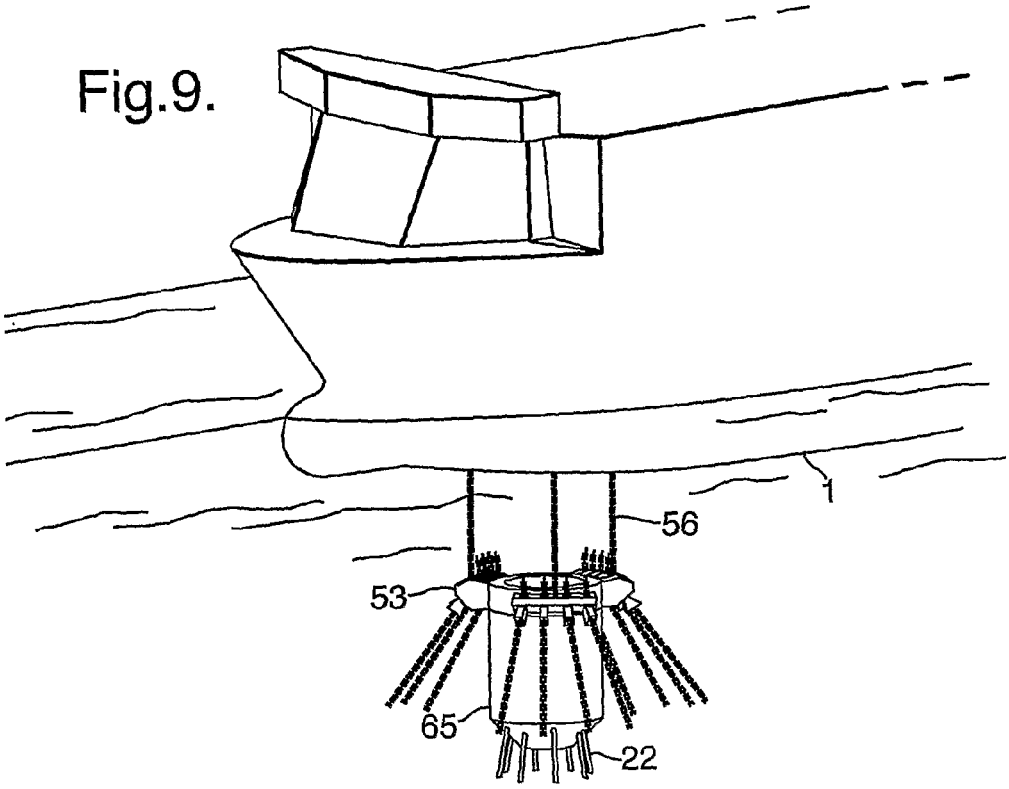
Figure 10:
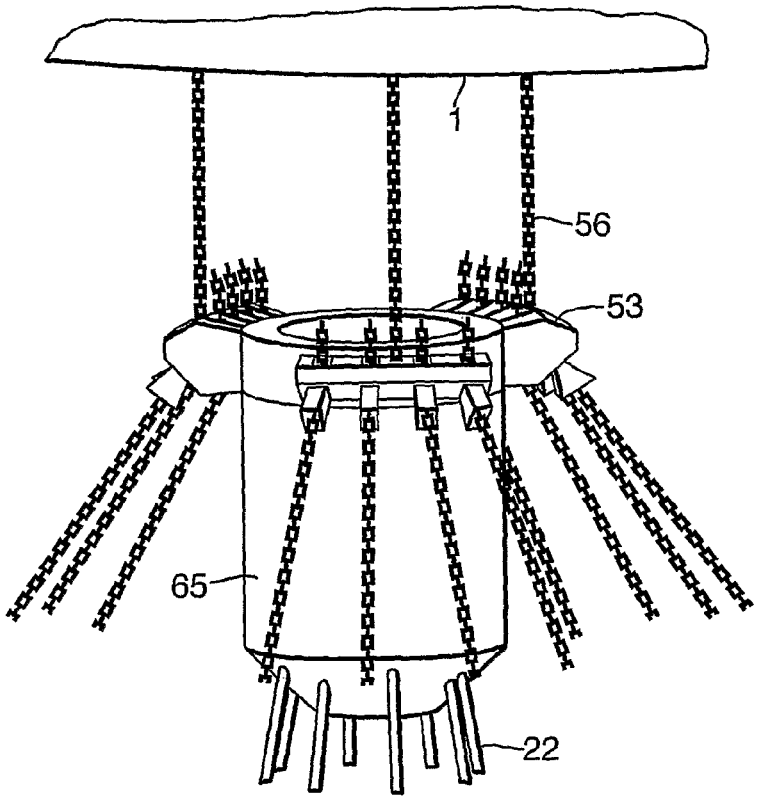
Figure 11:
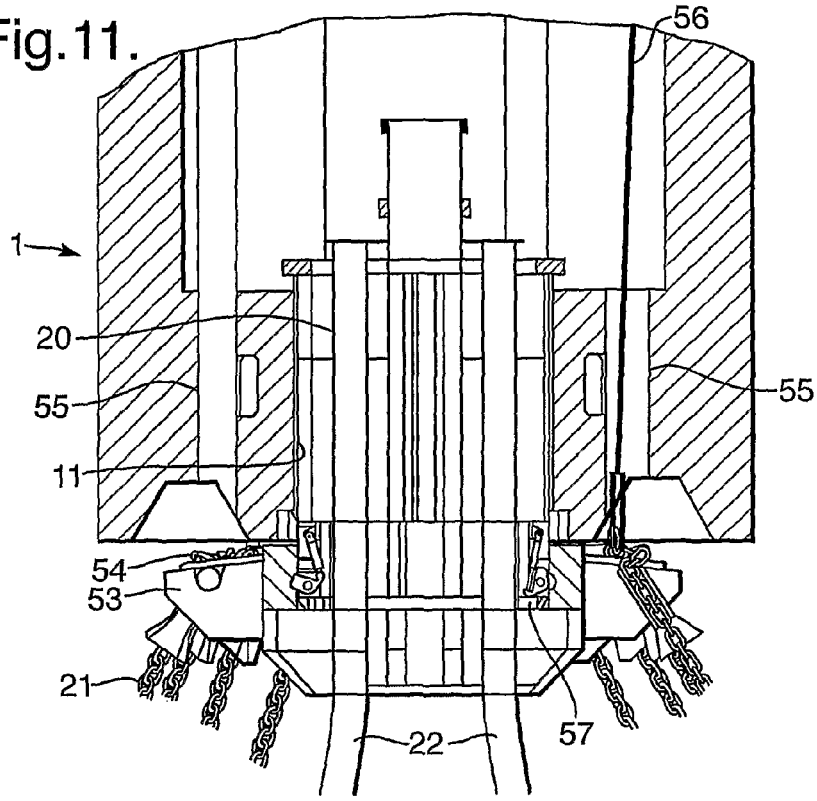
Figure 12:
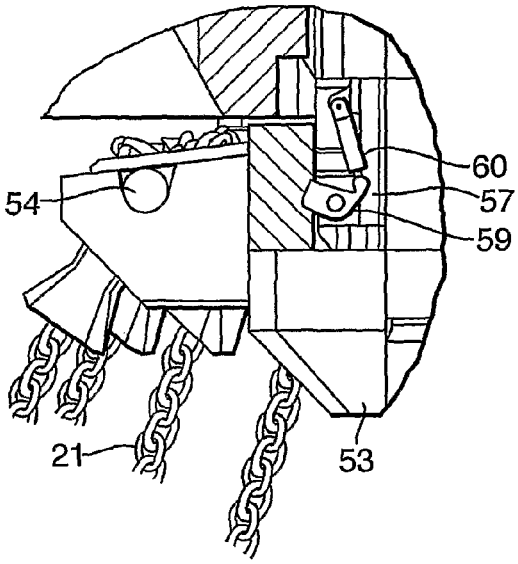
Figure 13:
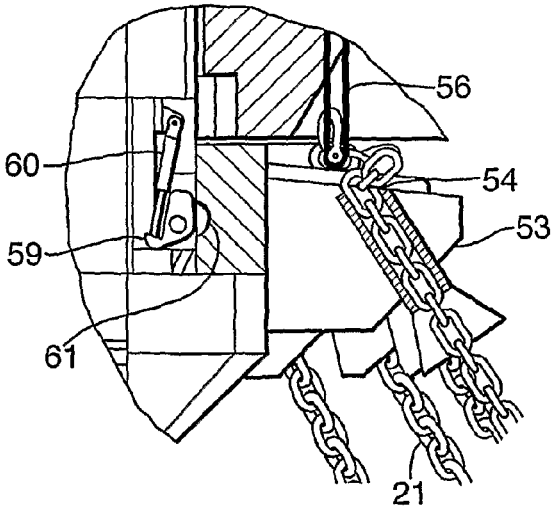

The invention will now be explained in more detail with reference to the drawing, in which:

FIG. 1 is a section of a cross section through a converted tanker with the anchoring and riser arrangement, FIG. 2 is a section through the axial and radial bearing of the rotatable body, with primary seal and secondary seal, FIG. 3 is a perspective section viewed from above of the axial and radial annular bearings respectively in FIG. 2, FIG. 4 is a section viewed from above of the bearing in FIGS. 2 and 3, FIG. 5 is an isometric view of a bearing segment according to the invention, FIG. 6 is a section through the bearing segment in FIG. 5, FIG. 7 illustrates the front part of a converted tanker, with an anchoring table mounted under the ship, FIG. 8 illustrates the anchoring table with buoy, on a larger scale, FIG. 9 illustrates the front part of a converted tanker, with a modified anchoring table mounted under the ship, FIG. 10 illustrates the anchoring table in FIG. 9, on a larger scale, FIG. 11 is a section through the vertical shaft in a ship, with rotating body and connected anchoring table, FIGS. 12 and 13 are respective detail sections illustrating a possible interlocking of rotating body and anchoring table.

In FIG. 1 the rotatable body 11 is depicted set in position in a vertical shaft 6 in a ship's hull 1. The shaft 6 may be provided in a cassette 5 which is incorporated in the hull 1, as described in the parallel patent application mentioned at the beginning.

The body 11 has a bottom side 12 and a top side 13 and, as illustrated in FIG. 1, is constructed as a cylindrical plate structure with an external cylinder 14 and a central stem 15 extending from the body's 11 bottom side 12 up through the top side 13. In FIG. 1 there are illustrated two horizontal annular plates 16, 17 which are welded in between the central stem 15 and the external cylinder 14. Stiffeners and other structural elements known to a person skilled in the art are not shown. The body 11 may of course be constructed in other ways which will be well-known to the skilled person.

At its top side 13 the body 11 has a flange 18, see also FIG. 2. This flange 18 is used for the rotational mounting of the body 11, as illustrated in FIG. 2. This will be described in more detail below.

In the annular space between the central stem 15 and the external cylinder 14, the body 11 has a number of guides 19, 20 provided for mooring cables 21 and risers 22 respectively.

The mooring cables 21 are tightened by means of a winch 23 on the vessel's deck 24. On the deck are mounted a number of cable guides 25 (only one is illustrated in FIG. 1), thus enabling the mooring cables 21 to be operated by one and the same winch 23. The mooring cables 21 are suspended in a manner not shown in greater detail at 26 on the body's 11 top side 13, with the result that the mooring cables do not extend up into the shaft after anchoring is accomplished.

The individual risers 22 ascend to a respective valve block 27 mounted on the top of the central stem 15. Each such valve block 27 comprises an ESD (emergency shut-down) valve.

On the central stem 15 is mounted a fluid manifold column 28, from which fluid lines 29 extend to the tanks on board the vessel.

Around the central stem 15 there is also provided an operating deck 30.

The space in the shaft 6 above the body's 11 top side 13 is dry. The body 11 is arranged in the tanker's bottom area 70, and is considered to be a wet vessel area 71.

We now refer to FIG. 2 and succeeding FIGS. 3-6 for an account of the body's 11 mounting in the shaft 6. In the transition between the shaft's lower section 7 and the shaft's upper section 8 there is provided a packing and bearing arrangement, comprising a segmented axial annular bearing 31 and a segmented radial annular bearing 32. The axial bearing 31 has a number of bearing segments 33. The radial annular bearing 32 also includes bearing segments 34, in this case a smaller number (half) than the bearing segments 33 in the axial bearing.

Above the two annular bearings 31, 32 is mounted a dynamic primary seal 35 between the body's 11 flange 18 and a console 36. Above this dynamic primary seal is mounted a back-up bearing 37, in order to prevent the rotatable body 11 from being lifted up. This back-up bearing 37 forms a part of several plate segments 38 that are screwed to the console 36 by a number of screws 39, see also FIG. 3. The plate elements 38 are provided with connecting flanges 40 which can be screwed together with the connecting flanges on adjacent plate elements, thereby forming an encircling deck shield.

Under the flange 18 is mounted a secondary seal 41. This is intended to only be activated during inspection/replacement of the bearing elements 33, 34. In addition there is a seal 42. This is only intended for use if the secondary seal 41 has to be replaced, in which case, therefore, it is only a matter of a mounting seal.

As mentioned above, the two annular bearings 31, 32 are composed of bearing segments 33 and 34 respectively. These bearing segments are basically identical in design and therefore only the construction of one bearing segment 33 will be described in detail below, with reference to FIGS. 5 and 6.

As illustrated in FIGS. 5 and 6, the bearing segment 33 is composed of a box 43 on which are mounted an upper wearing part 44, an intermediate part 45 and a height-adjustable bottom part 46, consisting of two interacting wedge elements 47, 48. The wearing part 44 is made of a suitable material, which will be well-known to a person skilled in the art, and the intermediate part 45 is advantageously made of a reinforced rubber material, which will provide a degree of resilience. The wedges 47, 48 can be moved relative to each other by means of adjusting elements 49 only outlined in FIG. 10. By altering the relative position of the wedge elements, the height of the bearing segment 33 can be adjusted.

The bearing segment 33 is envisaged provided with pressure lubrication, as indicated by the pipe 50, from which branch pipes 51 extend to cruciform grooves 52 in the wearing part 44. As already mentioned, pressurised water lubrication may be employed to particular advantage.

It should be mentioned at this point that the bearing segments can operate in several modes depending on the operating conditions; passive without any kind of lubrication, standard slide bearing; slide bearing with the capability of injecting grease; active pressure lubrication by injecting a medium, typically water, which provides separation of the surfaces, i.e. a hydrostatic bearing.

The body 11 is also mounted at the ship's bottom in a known per se manner. The lower radial bearing is not shown, but it too is in the form of a segmented annular bearing. In order to reduce the body's 11 non-circularity to a minimum, it will be advantageous to mount a machined stainless steel ring at the bearing point. The steel ring will ensure a uniform and continuous load distribution round the body's 11 circumference. In order to protect the steel ring against corrosion, a cathodic protective system is provided.

It is a significant advantage that there is access for inspection, adjustment and replacement of all bearings and their segments.

In FIG. 1 mooring cables and risers are passed up through guides in the rotatably mounted body 11. It is known that the rotating body 11, as a geostationarily mounted body, will have a tendency to follow the ship's rotation under the influence of wind and weather or when the ship rotates under the influence of a DP-system (dynamic positioning). This is due to the inertia in the mounting of the rotating body. One way of avoiding this is to have a driving unit in the rotating body, thus enabling it to be turned positively. Another way is to provide larger lever arms for the mooring cables, where they are connected to the rotating body, i.e. at the lower annular bearing for the rotating body in the shaft.

FIG. 11 illustrates a possible embodiment where an anchoring table 53 is mounted which is connected to the rotating body 11, in the bottom thereof. The anchoring table 53 has pick-up attachments 54 which are provided with a larger diameter than the rotating body 11, with the result that, due to the fact that they are suspended in the pick-up attachments 54 in the table 53, the mooring cables 21 acquire a larger lever arm relative to the rotating body 11. In FIG. 11 vertical guides 55 are illustrated for lifting means 56 for raising the anchoring table 53 towards the rotating part 11. Between the rotating part 11 and the anchoring table 53 are provided connecting means 57, see FIGS. 12 and 13. The risers 22 are connected to the anchoring table 53, and in the rotating body 11 are mounted suitable coupling ends 58 for interaction with the risers 22 when they are raised together with the table 53.

The anchoring table may be connected to the rotating body in several possible ways: it may be welded in against the rotating body at the shipyard; it may be attached to the rotating body via a bolted/mounted connection, which enables everything to be easily dismantled; it may be pulled in towards the rotating body in the field and connected to the rotating body manually from the ship; or it may be connected up in a more remotely controlled manner.

The anchoring table 53 with associated riser 22 is located anchored submerged in the water when the ship 1 is moved in over it. The lifting means (wires) 55 are attached to the anchoring table 53, and by means of winches (not shown) the anchoring table 53 is raised and connected with the rotating body 11 by means of the couplings 57 illustrated in FIGS. 12 and 13. The same or a similar winch arrangement as in FIG. 1 may, for example, be employed. The couplings 57 contain rotatably mounted claws 59, which by means of working cylinders 60 can be brought into engagement with cut-outs inside the anchoring table 53.

In order to keep the anchoring table 53 afloat, submerged in the water, before connection, the anchoring table 53 is attached to a buoy, as can be seen, for example, in FIG. 7 or 9.

In FIG. 7 a buoy 62 is provided on the upper side of the anchoring table 53. When connection between the rotating body 11 and the anchoring table 53 is to be undertaken, a wire 63 (or several) is lowered from the ship from a non-illustrated ship's crane to the buoy 62. The lifting means 56 (not shown) are attached to the anchoring table 53, in this case by being connected to the wires 64. The buoy 62 is inflated. By a controlled release of air from and introduction of water into the buoy 62, after the anchoring table 53 is attached to the lifting means 56, the buoy 62 can be neutralised and released from the anchoring table 53, suspended in the wire 63. The buoy 62 can then be moved sideways in a controlled manner and away into the water (not shown), whereupon the anchoring table 53 can be raised by the lifting means 56 and connected to the rotating body 11, as shown in FIGS. 11-13.

In FIG. 9 the buoy 65 is arranged under the table 53 and accompanies the anchoring table 53 up towards the rotating body 11 after the wires 56 are connected. In this case too the buoy's buoyancy can be controlled with air and water, as will be known to a person skilled in the art. Here, the risers 22 are passed through the buoy 65.

It will be apparent from FIGS. 7 and 9 that the anchoring and riser arrangement, as known, is arranged near forward perpendicular, where the ship's 1 beam moment and deformations are small, while sufficient structural strength is retained.

The invention has now been explained with non-limiting embodiments. A skilled person will appreciate that a multiplicity of changes and modifications can be made with regard to the described embodiments which are within the scope of the invention as defined in the following claims.

The invention claimed is:

1. A geostationary anchoring and riser arrangement in a vessel comprising a vertical shaft in the hull of the vessel, the vertical shaft comprising a wet vessel area in a bottom area, a segmented annular axial bearing and a segmented annular radial bearing mounted in the vertical shaft, a body in the wet vessel area of the vertical shaft and mounted to the axial and radial bearings such that the body is rotatable about a vertical axis, which body has a top side and a bottom side, guides for risers between the top side and the bottom side, is provided with an overlying fluid manifold connected to the risers, and is anchored to a seabed by a number of mooring cables, wherein there is provided a dynamic primary seal between the body and the vessel above said axial and radial bearings, and a secondary seal between the body and the vessel under said axial and radial bearings, wherein a fluid manifold column is supported by a central stem projecting from the body top side.

2. A geostationary anchoring and riser arrangement according to claim 1, wherein the mooring cables are connected to an anchoring table mounted under the body.

3. A geostationary anchoring and riser arrangement according to claim 1, wherein the anchoring table is attached to a buoy, thereby enabling it to float submerged in water when it is not connected to the body.

4. A geostationary anchoring and riser arrangement according to claim 1, wherein, above the body's top side, there is provided an operating deck round the central stem.

5. A geostationary anchoring and riser arrangement according to claim 4, wherein each riser is connected to a respective valve block with an ESD (emergency shut-down) valve, the valve blocks being mounted on top of the stem.

6. A geostationary anchoring and riser arrangement according to claim 1, wherein the body comprises an external cylinder and a central stem projecting from a bottom side up through a top side of the body, and wherein guides for risers are provided in an annular space between the central stem and said external cylinder.

7. A geostationary anchoring and riser arrangement in a vessel comprising a vertical shaft in the hull of the vessel, the vertical shaft comprising a wet vessel area in a bottom area, a segmented annular axial bearing and a segmented annular radial bearing mounted in the vertical shaft, a body in the wet vessel area of the vertical shaft and mounted to the axial and radial bearings such that the body is rotatable about a vertical axis, which body has a top side and a bottom side, guides for risers between the top side and the bottom side, is provided with an overlying fluid manifold connected to the risers, and is anchored to a seabed by a number of mooring cables, wherein there is provided a dynamic primary seal between the body and the vessel above said axial and radial bearings, and a secondary seal between the body and the vessel under said axial and radial bearings, wherein at least one of the segmented annular bearings comprises a bearing segment comprising a wearing part against the body, an intermediate part, and a height-adjustable bottom part against the vessel.

8. A geostationary anchoring and riser arrangement according to claim 7, wherein the bottom part comprises interacting wedges which can be moved relative to each other for height adjustment of said bearing segment.

9. A geostationary anchoring and riser arrangement according to claim 7, wherein said wearing part is provided with cruciform grooves connected to pipes providing a medium for lubrication of said bearing's bearing segments.

10. A geostationary anchoring and riser arrangement according to claim 9, wherein said medium for lubrication is water.

11. A geostationary anchoring and riser arrangement according to claim 7, wherein said intermediate part is made of a reinforced rubber material.

* * * * *